US011034570B2

(12) United States Patent
Hevia et al.

(10) Patent No.: US 11,034,570 B2
(45) Date of Patent: Jun. 15, 2021

(54) SYSTEMS AND METHODS FOR DISPENSING AND TRACKING MULTIPLE CATEGORIES OF BEVERAGES

(71) Applicant: DraftServ Technologies, LLC, Suwanee, GA (US)

(72) Inventors: Jose Hevia, Suwanee, GA (US); Tobi Pequignot, Atlanta, GA (US); Kevin Nye, Cumming, GA (US); Hitesh Patel, Atlanta, GA (US)

(73) Assignee: DraftServ Technologies, LLC, Suwanee, GA (US)

( * ) Notice: Subject to any disclaimer, the term of this patent is extended or adjusted under 35 U.S.C. 154(b) by 0 days.

(21) Appl. No.: 16/673,170

(22) Filed: Nov. 4, 2019

(65) Prior Publication Data

US 2020/0062572 A1 Feb. 27, 2020

Related U.S. Application Data

(63) Continuation of application No. 15/220,850, filed on Jul. 27, 2016, now Pat. No. 10,464,800.

(51) Int. Cl.
*B67D 1/08* (2006.01)
*B67D 1/12* (2006.01)
(Continued)

(52) U.S. Cl.
CPC ..... *B67D 1/0888* (2013.01); *B67D 1/0855* (2013.01); *B67D 1/0877* (2013.01); *B67D 1/0881* (2013.01); *B67D 1/0884* (2013.01); *B67D 1/1218* (2013.01); *B67D 1/1234* (2013.01); *B67D 1/1279* (2013.01); *G07F 9/026* (2013.01); *G07F 13/065* (2013.01); *B67D 1/0021* (2013.01); *B67D 1/124* (2013.01); *B67D 2001/0093* (2013.01);
(Continued)

(58) Field of Classification Search
CPC .. B67D 1/0888; B67D 1/1234; B67D 1/1218; B67D 1/0884; B67D 1/0855; B67D 1/0877; B67D 1/0881; B67D 1/1279; B67D 1/124; B67D 2001/0093; B67D 2210/00089; B67D 1/0021; B67D 2210/00091; B67D 2001/0094; G07F 13/065; G07F 9/026
See application file for complete search history.

(56) References Cited

U.S. PATENT DOCUMENTS 4,120,425 A * 10/1978 Bethurum ..... B67D 1/045 222/146.6
4,830,511 A * 5/1989 Smazik ..... B67D 1/0037 222/129.3
(Continued)

*Primary Examiner* — Donnell A Long
(74) *Attorney, Agent, or Firm* — Thomas | Horstemeyer, LLP

(57) ABSTRACT

Disclosed are various embodiments for dispensing and tracking beverages. An identifier associated with a user can be read by an identification device. Beverage availability information for the user can be determined. The beverage availability information can specify categories of beverages that the user is authorized to dispense. Valves can be selected that correspond to the authorized beverage categories. The valves can be enabled to allow the user to dispense beverages from the authorized beverage categories. The quantity of beverages dispensed can be tracked.

20 Claims, 7 Drawing Sheets

(51) Int. Cl.
*G07F 13/06* (2006.01)
*G07F 9/02* (2006.01)
*B67D 1/00* (2006.01)

(52) U.S. Cl.
CPC ..... *B67D 2001/0094* (2013.01); *B67D 2210/00089* (2013.01); *B67D 2210/00091* (2013.01)

(56) References Cited

U.S. PATENT DOCUMENTS 5,769,271 A 6/1998 Miller
7,439,859 B2 10/2008 Humphrey
7,551,089 B2 6/2009 Sawyer
7,617,850 B1 11/2009 Dorney
7,834,765 B2 11/2010 Sawyer
7,845,375 B2 12/2010 Dorney
7,997,448 B1 8/2011 Leyva
8,127,805 B2 3/2012 Dorney
8,130,083 B2 3/2012 Dorney
8,151,832 B1 4/2012 Dorney
8,245,739 B1 8/2012 Wade et al.
8,304,815 B2 11/2012 Yamaguchi
8,408,255 B1 4/2013 Wade et al.
8,523,065 B1 9/2013 Wade et al.
8,584,900 B2 11/2013 Metropulos et al.
8,610,536 B2 12/2013 Libby et al.
8,776,838 B1 7/2014 Dorney
8,833,241 B2 9/2014 Santoiemmo
8,842,013 B2 9/2014 Sawyer
8,896,449 B2 11/2014 Sawyer
8,972,048 B2 3/2015 Canora et al.
9,026,245 B2 5/2015 Tilton et al.
9,334,149 B2 5/2016 Dorney
9,434,596 B2 9/2016 Carpenter et al.
9,499,387 B2 11/2016 Nicol et al.
9,533,867 B2 1/2017 Hortin
9,622,615 B2 4/2017 Hecht et al.
2004/0000560 A1* 1/2004 Henry ..... B67D 1/1234 222/59
2011/0049180 A1 3/2011 Carpenter et al.
2011/0168775 A1 7/2011 Van Zetten
2011/0298583 A1 12/2011 Libby et al.
2012/0285986 A1 11/2012 Irvin
2015/0217985 A1 8/2015 Raley
2016/0090288 A1 3/2016 Givens, Jr. et al.
2016/0092851 A1 3/2016 De Berg Hewett
2016/0355389 A1* 12/2016 Bursey ..... B67D 1/0884
2017/0121165 A1 5/2017 Gabrieli
2017/0174496 A1 6/2017 Gold et al.
2018/0029859 A1 2/2018 Hevia et al.

* cited by examiner

100

SYSTEMS AND METHODS FOR DISPENSING AND TRACKING MULTIPLE CATEGORIES OF BEVERAGES

CROSS-REFERENCE TO RELATED APPLICATIONS

This application is a continuation of, and claims priority to, copending U.S. patent application Ser. No. 15/220,850, entitled "SYSTEMS AND METHODS FOR DISPENSING AND TRACKING MULTIPLE CATEGORIES OF BEVERAGES" and filed on Jul. 27, 2016, which is incorporated by reference herein in its entirety.

BACKGROUND

Soda fountains are devices that dispense carbonated soft drinks. A soda fountain can combine flavored syrup or syrup concentrate with carbonated water to make soda. The syrup can be stored in a bag-in-box (BIB) or a cartridge. A soda fountain is considered a postmix machine because the machine mixes the soda at the point of sale rather than premixing the soda in a bottle or can.

Similarly, draft beer can be dispensed from a cask or keg. The keg can be artificially pressurized using carbon dioxide and/or nitrogen gas after fermentation of the beer. The draft beer can also be filtered or pasteurized before being stored and served. While at an establishment, the keg can be stored in a refrigerated environment to regulate the temperature of the draft beer when served. Other beverages, such as wine, water, juice, coffee, and tea, can similarly be served from a dispenser, with or without carbonation.

Restaurants, concession stands, cruise ships, and other establishments use soda fountains and beer casks or kegs to dispense beverages to consumers. Customers can order drinks from a server or self-serve at a self-service station. In some beverage dispensers, a manual switch can be triggered to begin dispensing of a beverage and released to end the dispensing of the beverage.

SUMMARY

Disclosed are systems and methods for dispensing beverages, tracking a history of beverages dispensed and to which customer the beverage was dispensed, and charging or billing customers for the beverages acquired. A networked environment can include a data store with beverage availability information corresponding to an identifier. The identifier can correspond to a customer or user of the networked environment. Fluid dispensers can be configured to enable a valve to allow for a beverage to be dispensed. A flow meter can sense an amount of the beverage dispensed.

Each of the beverages can be assigned to a beverage category. Various settings for the system can be configured based on the category of the beverage. For example, a temperature setting, a pressure setting, a density setting, and other configurations can be specified per beverage or per category of beverage.

An identification device can be configured to read the identifier from an identification item, such as an RFID card, a Bluetooth device, or other identification items described herein. A computing device can be communicably coupled to the beverage dispensers, such as, for example, through a PLC. The computing device can also be communicably coupled to the identification device. The coupling can be through a USB port, a network port, a serial port, or another connection types.

A computing device can execute a beverage service to select a valve to enable based on the beverage availability information. As an example, the beverage availability information may indicate that a customer associated with the identifier is under 21 and thus unable to drink beverages within the alcoholic category. The beverage availability information may also indicate that the customer is allowed to drink from the soda category. As such, the computing device can enable valves associated with beverages from the soda category, while leaving closed valves associated with beverages from the alcoholic category. To enable or disable a valve, the computing device can send a command to a communication and control device, such as a PLC or a microprocessor. The computing device can determine an amount of the beverage dispensed based on a flow meter.

These and other aspects, objects, features, and embodiments will become apparent to a person of ordinary skill in the art upon consideration of the following detailed description of illustrative embodiments exemplifying the best mode as presently perceived.

BRIEF DESCRIPTION OF THE DRAWINGS

For a more complete understanding of the embodiments and the advantages thereof, reference is now made to the following description, in conjunction with the accompanying figures briefly described as follows.

Figure 1:
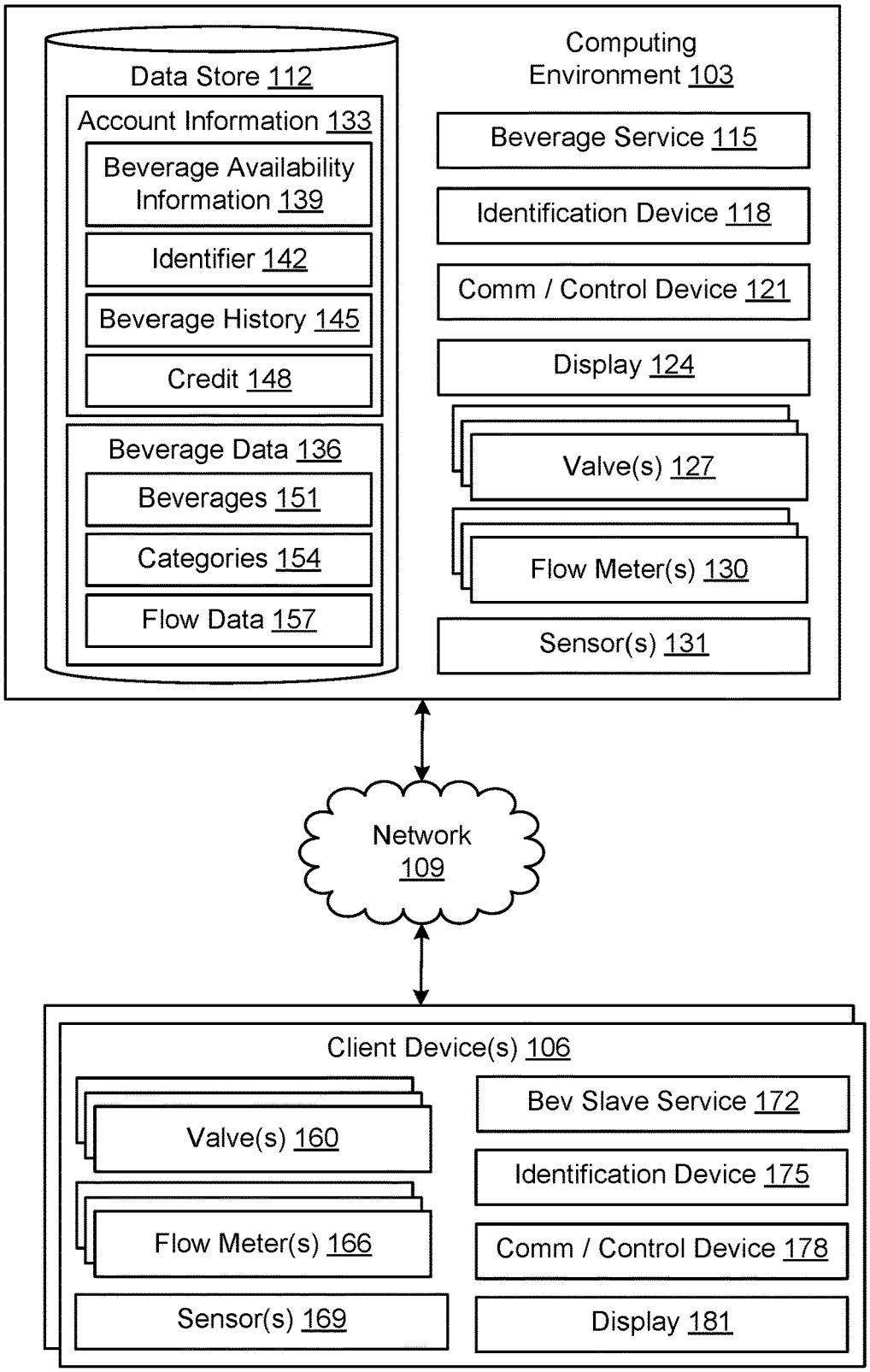
FIG. 1 is a drawing of a networked environment according to various example embodiments.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

In the following paragraphs, the embodiments are described in further detail by way of example with reference to the attached drawings. In the description, well known components, methods, and/or processing techniques are omitted or briefly described so as not to obscure the embodiments. As used herein, the "present invention" refers to any one of the embodiments of the invention described herein and any equivalents. Furthermore, reference to various feature(s) of the "present invention" is not to suggest that all embodiments must include the referenced feature(s).

Among embodiments, some aspects of the present invention are implemented by a computer program executed by one or more processors, as described and illustrated. As would be apparent to one having ordinary skill in the art, the present invention may be implemented, at least in part, by computer-readable instructions in various forms, and the present invention is not intended to be limiting to a particular set or sequence of instructions executed by the processor.

The embodiments described herein are not limited in application to the details set forth in the following description or illustrated in the drawings. The invention is capable of other embodiments and of being practiced or carried out in various ways. Also, the phraseology and terminology used herein is for the purpose of description and should not be regarded as limiting. The use of "including," "comprising," or "having" and variations thereof herein is meant to encompass the items listed thereafter, additional items, and equivalents thereof. The terms "connected" and "coupled" are used broadly and encompass both direct and indirect connections and couplings. In addition, the terms "connected" and "coupled" are not limited to electrical, physical, or mechanical connections or couplings. As used herein the terms "machine," "computer," "server," and "work station" are not limited to a device with a single processor, but may encompass multiple devices (e.g., computers) linked in a system, devices with multiple processors, special purpose devices, devices with various peripherals and input and output devices, software acting as a computer or server, and combinations of the above.

With reference to FIG. 1, shown is a networked environment 100 according to various embodiments. The networked environment 100 includes a computing environment 103 and a one or more client devices 106, which are in data communication with each other via a network 109. The network 109 can include, for example, the Internet, intranets, extranets, wide area networks (WANs), local area networks (LANs), wired networks, wireless networks, or other suitable networks, etc., or any combination of two or more such networks. For example, such networks may comprise satellite networks, cable networks, Ethernet networks, and other types of networks. In some embodiments, the networked environment 100 includes no client devices 106 or network 109.

The computing environment 103 can include, for example, a client computing device, a server computer, or any other system providing computing capability. Alternatively, the computing environment 103 can employ a plurality of computing devices that may be arranged, for example, within a cabinet of a dispensing station or in one or more server banks or computer banks or other arrangements. Such computing devices can be located in a single installation or may be distributed among many different geographical locations. For example, the computing environment 103 can include a plurality of computing devices that together can include a hosted computing resource, a grid computing resource and/or any other distributed computing arrangement. In some cases, the computing environment 103 can correspond to an elastic computing resource where the allotted capacity of processing, network, storage, or other computing-related resources may vary over time.

Various applications and/or other functionality may be executed in the computing environment 103 according to various embodiments. Also, various data is stored in a data store 112 that is accessible to the computing environment 103. The data store 112 can be representative of a plurality of data stores 112 as can be appreciated. The data stored in the data store 112 for example, is associated with the operation of the various applications and/or functional entities described below.

The components of the computing environment 103, for example, include a beverage service 115, an identification device 118, a communication and control device 121, a display 124, one or more valves 127, one or more flow meters 130, one or more sensors 131, and other applications, services, processes, systems, engines, electrical components, or functionality not discussed in detail herein. The beverage service 115 is executed to facilitate dispensing, measuring, and monitoring of beverages from various beverage categories. The beverage service 115 can communicate with communication and control device 121 to enable and disable valves 127.

The identification device 118 can include one or more of a barcode scanner, an RFID reader, a magnetic stripe reader, a biometric scanner, a QR Code reader, a Near Field Communication (NFC) reader, a Bluetooth device, a camera, a fingerprint reader, a retinal scanner, and other identification devices. The Bluetooth device can be a Bluetooth beacon installed for a user to interact through an application on a smart phone. The beverage service 115 can capture a video or image of a user using the camera. The beverage service 115 can render a user interface on the display 124. The display 124 can include, for example, one or more devices such as liquid crystal display (LCD) displays, gas plasma-based flat panel displays, organic light emitting diode (OLED) displays, electrophoretic ink (E ink) displays, LCD projectors, or other types of display devices, etc.

The user interface can include advertisements, beverage availability information, balance informations, customer alerts, social media feeds, beverage history data, administrative workflows, and other user interfaces. The beverage availability information can show "Category not available on this station," when the user wants a category 154 not available. The advertisements can include video and/or static images promoting a product or service. The customer alerts can be based on demographic information of the user. As an example, the account information 133 can include demographic information for a user corresponding to the identifier 142.

The user interface can display beverage history data including the top selling beverages 151 from a category 154. In one embodiment, ranked lists of top selling beverages 151 for each category 154 available on the computing environment 103 or the client device 106 can be rendered side-by-side on the display 124. The top selling ranking can be based on a sales interval, such as, sales in the past day, past week, or past year. The user interface can display the top tabs for users. For example, a list of identifying information for identifiers 121 ranked by credit 148 spent by the identifier 142 or other beverage history 145 for each identifier can be rendered on the user interface.

In some embodiments, the beverage service 115 determines demographic information based on a photograph. For example, the beverage service 115 can determine that a customer appears under 21 years of age based on analyzing a photograph of the customer. The customer alerts can change a color of the screen when a customer appears to under 21 to alert administrators to manually check identification of the customer.

The communication and control device 121 can be one or more programmable logic controllers (PLC), a computing device, and other an electrical circuits. In one embodiment, the computing device is a Raspberry Pi. The communication and control device 121 can communicate with the beverage service 115, such as, for example, through a USB port, a serial port, a network port, a parallel port, a general input/output port, or other communication connection. In one embodiment, a single communication and control device 121 communicates to the beverage service 115 and one or more beverage slave services 172 controlling valves 127 and valves 160 for one or more client device 106. The communication and control device 121 can also include one or more controls. As an example, a pressure control can be used to adjust a pressure on a supply line. In another example, a temperature control is used to set a target temperature in a refrigerated space, such as a kegerator or a refrigerator. In one example, the communication and control device 121 includes a PLC device in communication with a pressure control and a temperature control.

In one embodiment, the beverage service 115 can adjust a pressure using the communication and control device 121 based on a desired pressure stored in the beverage data 136 for a beverage 151. In one example, each beverage 151 can correspond to a different pressure regulator and be adjusted based on a desired pressure for a beverage 151. In another example, one or more sets of beverages 151 use the same pressure, and a pressure regulator corresponding to each set is configured based on the desired pressure for the set of beverages 151. Similar to pressure, the temperature can be adjusted for a single beverage 151, a set of beverages 151, or all beverages 151. The sets of pressure and/or temperature can each correspond to all beverages in a category 154. Thus, the pressure and temperature can be configured for each beverage category 154.

In some embodiments, a single communication and control device 121/178 can be in communication with the beverage service and/or one or more beverage slave services. As an example, a single communication and control device 121/178 can control and monitor the valves 127, the flow meter 130, and the sensors 131 on a computing environment 103 in addition to controlling and monitoring the valves 160, the flow meter 166, and the sensors 169 on a client device 106. In this example, a beverage service 115 can open and close valves 127 by sending commands to the communication and control device 121/178 while a beverage slave service 172 can open and close valves 160 by sending commands to the same communication and control device 121/178.

The valve 127 can be a dole valve, a direct acting valve, a media isolated valve, a pinch valve, a gate/knife valve, a ball valve, a butterfly valve, a pneumatic valve, and other types of valves. When enabled, a valve 127 can dispense a beverage when a manual switch is triggered for the valve 127. In some embodiments, enabling the valve 127 directly causes the dispensing of the beverage. Each of the valves 127 can correspond to a different beverage dispenser. Further, each beverage dispenser can correspond to a different beverage 151, which belongs to different categories 154. A visual presentation can occur when a user is dispensing a beverage 151. As an example, LEDs can be illuminated to interact with a customer while the beverage 151 is being dispensed. In another example, a video can be rendered or an audio file can be rendered for the customer.

The communication and control device 121 can open and control a valve 127 by opening and closing a relay switch within the valve 127. To control the valve 127, the communication and control device 121 can send a command using telnet, a proprietary protocol, Modbus protocol, TCP/IP, or other protocols or communication technologies.

A flow meter 130 can be an ultrasonic meter, a turbine, a vortex, a switch, and other flow meters. The flow meters 130 can be individually paired with the valves 127. In some embodiments, a single flow meter 130 can be used for more than one valve 127. In yet another embodiment, the flow meter 130 is a switch in the valve indicates a start and stop to the dispensing of a beverage at a specific valve 127. In this embodiment, the beverage service 115 can determine an amount of time that a beverage was dispensed at the valve based on the amount of time. As such, a flow meter 130 can measure an amount of fluid dispensed from a beverage dispenser that corresponds to a valve 127.

The communication and control device 121 can count pulses from an input to determine rate of flow. As an example, the flow meter 130 can pulse when a predefined amount of fluid passes through the flow meter. The communication and control device 121 can count the pulses from the flow meter 130 to determine an amount of a beverage that has passed through the flow meter 130.

The beverage service 115 can determine that a remedial action is necessary based on a flow rate for a valve 127. In one embodiment, when a flow threshold has been met, the beverage service 115 can determine a vessel is empty and take a remedial action. As an example, when a flow rate for beer increases to meet a threshold, a keg may be empty and dispensing air rather than beer. The remedial action can include sending a command to disable a corresponding valve 127, sending an error notification to an administrator, disconnecting power to the system, generating a visual warning on the display 124, generating an audio warning, or other remedial measure. The administrator may be an employee of a company operating the networked environment 100, such as a bar tender. The power can be disabled to one or more of the communication and control device 121, the valves 127, or the computing environment 103. The remedial action can also include informing a user of a length of time a beverage supply has been used, such as a duration that a keg has been taped or a time a syrup box was last changed for a beverage 151.

The beverage data 136 can include a level of each beverage 151 available and an amount of each ingredient in one or more beverage 151 in a container corresponding to one or more beverages 151. As an example, the beverage data 135 can include an amount of cola that can be dispensed based on an amount of cola syrup available and an amount of soda water available. The level of cola can be based on the formula for cola. For example, if the cola beverage requires five parts soda water and one part syrup, the maximum amount of cola that can be dispensed without replenishing ingredients is the lesser of an amount of cola syrup available or one fifth of an amount of soda water available.

The beverage service 115 can track a level of an ingredient based on subcomponents of the ingredient. For example, soda water can be created using filtered water and carbon dioxide. The beverage data 136 can include an amount of soda water that can be generated from a single bottle of carbon dioxide and an amount of soda water that can be generated from a water filter. The beverage service 115 can track an amount of soda water dispensed since the last change of a bottle of carbon dioxide or from the last change of a water filter to determine a remaining quantity of soda water available.

Similarly, the beverage service 115 can track an amount of syrup dispensed, beer dispensed, or other ingredient dispensed based on flow data. In one example, the beverage service 115 determines an amount of syrup dispensed based on a ratio of syrup used for a beverage 151 and a determined amount of soda water dispensed for the beverage 151 using a flow meter 130. A visual indicator in the computing environment 103 can be adjusted based on an amount of each ingredient available. For example, a green light can be illuminated when the ingredient above 60%, a yellow light can be illuminated when the ingredient is above 100% but at or below 60%, and a red light can be illuminated when the ingredient is at or below 10%. In another example, a bar graph is rendered showing a percentage of each ingredient remaining.

In one embodiment, a weigh scale can be used to determine an amount of an ingredient remaining. The beverage data 136 can include a weight when full for a bottle of a keg, a bottle of carbon dioxide, a box of wine, a containing holding coffee beans, a box of syrup, or another ingredient. The beverage service 115 can read a weight from the weight scale to determine a remaining quantity of the ingredient. In one embodiment, a sensor 131 can be placed inside of a vessel to determine a quantity remaining of an ingredient in the vessel.

The sensors 131 can include various sensors at different locations within the computing environment 103. The sensors 131 can measure pressure in various places. The computing environment 103 can include supply lines for carbonated water, syrup, and other beverages and beverage components. A pressure can be used to ensure that fluid flows through the supply line in a direction. The pressure can drop over the length of a supply line. The pressure sensors 131 can be configured to read pressure at various locations along the path of a fluid in the system. As an example, a pressure sensor 131 can measure pressure at the beverage dispenser, in a line of the beverage, at a pressure regulator, at a pressurized container, such as a bottle of gas of liquid, and/or at other locations.

The sensors 131 can also include temperature sensors. The computing environment 203 can include a refrigerated space that stores liquid. The temperature of the liquid can change while moving through supply lines. A temperature sensor 131 can measure a temperature of the fluid within the refrigerated space, at various locations within the supply lines, and at the beverage dispenser. As another example, the sensors 131 can include a liquid density sensor that can measure the density of liquid within a supply line or elsewhere in the system. In one embodiment, a carbonation level for a product can be determined based on a density sensor 131 or a pressure sensor 131. The carbonation level can be reported to an administrator.

The data stored in the data store 112 includes, for example, account information 133 and beverage data 136, and potentially other data. The beverage service 115 can use the account information 133 to authenticate a user, restrict access of the user to beverages, and track beverage consumption for the user. The account information 133 can include beverage availability information 139, identifiers 142, beverage history 145, and credit 148. The beverage data 136 can include beverages 151, beverage categories 154, and flow data 157. The beverage service 115 can use the beverage data 136 to identify categories 154 of beverages 151 that correspond to valves 127.

The beverage availability information 139 can include a global component and a user specific component. The global component can specify times when different beverage categories 154 are available for dispensing. For example, alcoholic beverages 151 may be unavailable after 4:00 AM or on Sundays for legal reasons. As another example, a wedding organizer may order one or more beverage categories 154 be unavailable during dinner. The beverage service 115 can enable and disable valves 127 associated with specific beverage categories 154.

The global component can specify a limit of a number of ounces per day for each identifier 142 or customer. As an example, when a limit is set to 60 ounces for a day, the beverage service 115 can determine an identifier 142 has poured a total of 60 ounces in three different dispensing sessions, and limit further beverages from being dispensed. In another example, a customer may be limited to 60 ounces for a day, and the beverage service 115 can determine that a single customer has poured 60 ounces using two different identifiers 121 based on recognizing the customer in an image or video captured with a camera. In response to determining that the single customer has poured the threshold number of ounces, the beverage service 115 can limit further beverages from being dispensed.

The limits can be specified by category 154 or beverage 151. As an example, an alcohol category 154 can be limited to 32 ounces per fifteen minutes. The limit can also be based on money. As an example, an identifier 142 can be limited to spending $50.00 per 15 minute period. A monetary limit can also be based on category 154. For example, an identifier 142 can be limited to $25.00 in purchases from a soda category 154 and limited to $50.00 for purchases from a beer category 154. A global monetary limit can also be used in addition to the category limit.

As an example, an identifier 142 can be limited to $100.00 in total purchases, while having a limit of $60.00 for a beer category 154, a $50.00 limit for a soda category 154, and a $40.00 limit for a wine category 154. In this example, the beverage service 115 can reject further purchases of beverages 151 from the beer category 154 when either $60.00 has been spent on beverages from the beer category 154 or a total of $100.00 has been spent across all categories 154. The beverage service 115 can also reject further purchases from all other categories 154 when the $100.00 has been spent across all categories 154, but not limit the purchase from other categories 154 when only the $60.00 limit on the beer categories 154 has been met.

The identifier 142 can correspond to a user account. The identifier 142 can have a group component and an individual component. For example, the group component can be common among members in a group, such as, for example, a family, while the individual component changes for each member in the group. The identifier 142 can be stored in a physical medium for use by a user and read by the identification device 118. As an example, the identifier 142 can be stored within an RFID card, a magnetic stripe, a QR code, a barcode, a cell phone, or another storage device. The identifier 142 can be stored in various devices as well. For example, a bracelet can include RFID media, which can become unreadable if the bracelet is removed. Further, the identifier 142 can be embedded in a cup, hat, neckless, or other item. The identifier 142 can also correspond to biometric data from a user. As an example, when a user registers, biometric data can be collected. The biometric data can include a picture of the user, a fingerprint, a retinal image, and mapping of veins on a wrist, and other biometric data for the user.

The identifier 142 can include multiple components. In some embodiments, only part of the identifier 142 can be stored in a physical medium. In some embodiments, multi-factor identification can be required for a user account. As an example, a numeric component of an identifier 142 can be stored on an RFID card, and when the RFID card is read by an RFID reading identification device 118, the beverage service 115 can capture a picture of the user using a camera and compared to a photographic component of the identifier 142. In other examples, a fingerprint reader is used in tandem with an RFID reader to validate both a numeric component and a biometric component of an identifier 142.

The identifier 142 can be validated using a smart phone. An identifier 142 can be programmed into the smart phone, or sent to an application running on the smart phone, such as, for example, during enrollment or upon logging into a user account in the application. In one example, an identifier 142 is sent by the smart phone through NFC or Bluetooth to the identification device 118. In another example, an application executed on the smart phone captures a fingerprint using a fingerprint scanner and sends the information to the identification device 118, such as, through the internet or network 109.

The beverage history 145 can include a history of beverages purchased using a specific identifier 142. As an example, beverage history 145 can specify that a user purchased two ounces of whiskey, 60 ounces of beer, 4 ounces of wine, and 128 ounces of cola. The beverage history 145 can also store timing information for purchases of beverages 151. For example, the beverage history 145 can identify that first ounce of whiskey was acquired at 11:45 PM on Jul. 20, 2016 while the second ounce of whiskey was acquired at 1:20 AM on Jul. 21, 2016. An image of a person dispensing the beverage 151 can be captured using a camera and stored in beverage history 145 associated with the dispensed beverage information.

In some embodiments, the beverage history 145 includes one or more events that occurred. As an example, the beverage history 145 record from networked environment 100 installed at a baseball stadium can specify that a user purchased 12 ounces of cola at 7:45 PM on Aug. 1, 2016 during the seventh inning of a baseball game while the weather was sunny with clear skies and a temperature of 102 degrees with attendance of 28,632. The beverage service 115 can process the beverage history 145 to determine order information for future events. As an example, the beverage service 115 can calculate a forecast of beverage consumption at a future baseball event where 31,271 tickets have been sold and the weather is forecasted to be sunny with a temperature of 98 degrees based on beverage consumption in beverage history 145 for past events.

The beverage service 115 can calculate a saturation level based on a number of drinks acquired during a predefined time interval. The saturation level can correspond to an estimated intoxication level for alcoholic beverages. In one example, the saturation level is an estimation of how dehydrated a user is based on a quantity of water, among other beverages, consumed during a period of time. The saturation level can also factor in weather for a given area when determining how dehydrated a user is at any given time. The saturation level can be based on a category 154 of each beverage 151 obtained in the beverage history 145. As an example, a dehydration level can increase when an alcoholic beverage or a coffee beverage is obtained, but may decrease when water is obtained.

The beverage data 136 can include a serving size for each beverage 151. In one example, a serving size is based on the category 154 of the beverage 151. As one illustrative example, a beer category 154 may have a 12 ounce serving size, a hard liquor category 154 may have a 1 ounce serving size, and a soda category 154 may have a 20 ounce serving size. In some embodiments, the beverage service 115 calculates a serving size based on an alcoholic percentage of a category 154 or beverage 151. In one example, a serving size for alcoholic beverages is set to 0.5 ounces for 100% alcohol, and the beverage service 115 determines a serving size of 1 ounce for a liquor with 50% alcohol, a serving size of 4 ounces for a wine with 12.5% alcohol, a serving size of 10 ounces for a beer with 5% alcohol, and a serving size of 12.5 ounces for a beer with 4% alcohol.

The beverage service 115 can disable an identifier 142 when a threshold quantity of a beverage is dispensed. The identifier 142 can be disabled access to a specific category 154 or beverage 151. As an example, the beverage service 115 can disable access to the alcoholic beverage category 154 when 128 ounces of alcoholic beverages in that category 154 have been dispensed for that identifier 142. The beverage service 115 can require a manual check before allowing further dispensing of beverages from that category. For example, an employee may be required to manually check a sobriety level of a user before enabling the user to acquire more beverages from an alcoholic category 154.

The credit 148 can store an amount that the user corresponding to an identifier 142 can use to acquire beverages. The credit 148 can be an amount of money, a number of points used to purchase beverages, a number of ounces, a number of drinks, or some other form of credit. When a beverage 151 is acquired, the beverage service 115 can deduct an amount from the credit 148. The amount deducted can be based on the beverage data 136. For example, an amount of four dollars can be deduced for a first beverage 151 while two dollars can be deducted for a second beverage.

The amount being deducted can be based on the category 154. In one example, a package purchased by a user can indicate that a category 154 free for a duration, and thus no amount is deducted from credit when acquiring beverages 151 from that category 154. In another example, a package can indicate that a predefined number of beverages 151 from a category 154 are free. When the number of beverages 151 for that category 154 is exceeded, the credit can be deducted for each beverage 151 purchased from that category 154. The quantity of free beverages 151 in a package can be reset on an interval, such as daily or weekly.

A quantity of beverages allowed can be limited based on one or more category 154 without limiting credit 148. As an example, an identifier 142 can be unable to acquire additional beverages 151 from a category 154 when a predefined number of beverages 151 from the category 154 have been acquired in a specific duration of time. In this example, the credit 148 can be deducted to pay for the beverages 151 up until the predefined number of beverages 151 have been acquired from the category 154. Further, beverages 151 can still be acquired for beverages 151 from other categories 154.

The flow data 157 can include recipes for the beverages 151 and ratios of flow for the recipe. As an example, a cola beverage may require 5 parts soda water with 1 part cola syrup while a lemon lime beverage 151 may require 4 parts soda water to 1 part syrup. In one embodiment, a single flow meter 130 can measure a flow rate of an ingredient shared by all beverages, such as soda water. A switch in each of the valves 127 can indicate which specific valve 127 is dispensing. The beverage service 115 can receive a rate of flow from the flow meter 130 and an indication of which valve 127 is dispensing.

The beverage service 115 can determine an amount of the beverage 151 has been dispensed based on the ratio of flow for the beverage 151. As an example, if the flow meter 130 indicates 10 ounces of soda water were dispensed and a switch corresponding to the valve 127 for the cola beverage 151 is triggered, the beverage service 115 can determine that 10 ounces of soda water mixes with 2 ounces of syrup to generate 12 ounces of cola.

In another embodiment, the flow meter 130 can be omitted and the beverage service 115 can determine a quantity of a beverage 151 dispensed based on a duration that the switch corresponding to a valve is triggered. As an example, the computing environment 103 may dispense one ounce per second for cola. The beverage service 115 can determine that 12 ounces of cola were dispensed based on a switch corresponding to the valve 127 for the cola beverage 151 being triggered for 6 seconds. The amount of the beverage dispensed can be used to determine a cost of a beverage, to store in beverage history 145 associated with the an identifier 142, to store in beverage data 136 for various purposes, such as reordering, and for other benefits.

The user specific component can include beverage availability for each identifier 142. As an example, an alcoholic beverage category 154 can be disabled for an identifier 142 when a user corresponding to the identifier 142 is under 21 years old. As another example, an identifier 142 can be authorized for a quantity of drinks from a specific beverage category 154. The quantity can be limited over a duration of time, over an event, or different quantities can be used for both.

The client device 106 is representative of a plurality of client devices that may be coupled to the network 109. The client device 106 can include, for example, a processor-based system such as a computer system. Such a computer system may be embodied in the form of a desktop computer, a laptop computer, personal digital assistants, cellular telephones, smartphones, set-top boxes, music players, web pads, tablet computer systems, game consoles, electronic book readers, or other devices with like capability. The client device 106 can include a one or more display 124.

The client device 106 can be configured to execute various applications such as a beverage slave service 172 and/or other applications. The client device 106 can include one or more valves 160, one or more flow meters 166, one or more sensors 169, a beverage slave service 172, identification device 175, a communication and control device 178, and a display 181. The valves 160 can be additional instances of valves 127. Similarly, the flow meters 166 and 130, sensors 169 and 131, identification devices 175 and 118, communication and control devices 178 and 121, and display 181 and 124 each can be separate instances of the same element, respectively.

The beverage slave service 172 may be executed in a client device 106, for example, to access network content served up by the computing environment 103 and/or other servers, thereby rendering a user interface on the display 181. In other embodiments, the beverage slave service 172 renders the user interface based on locally stored content.

Using a beverage slave service 172, the client device 106 can act as an extension of the computing environment 103. For example, additional valves 127 can be added as valves 160 for additional beverages 151 on a client device 106. Further, the additional valves 160 can provide additional beverage dispensers for the same beverages 151 that are offered by the computing device 103. The beverage slave service 172 can receive an identifier 142 from identification device 175, and send the identifier 142 to the beverage service 115 for verification. The beverage service 115 can send the beverage availability information 139 corresponding to the identifier 142 to the beverage slave service 172 in response to verifying the identifier 142.

Similarly to the beverage service 115, the beverage slave service 172 can use communication and control device 178 to enable and disable beverage dispensing from valves 160, measure a quantity of beverage dispensed using flow meters 166 and sensors 169. The beverage slave service 172 can send quantities of a beverage 151 dispensed from a valve 160 to the beverage service 115 through network 109. As an example, the beverage slave service 172 can determine that 12 ounces of cola were dispensed from a specific valve 160 and send the result to the beverage service 115 to be stored in data store 112, similarly to when beverages 151 are dispensed from valves 127.

In one embodiment, the beverage service 115 can send credit 148 for a verified identifier 142 to the beverage slave service 172. The beverage slave service 172 can calculate a cost of a beverage 151 dispensed from a valve 160, deduct the cost from the credit 148, and send the result to the beverage service 115. In another embodiment, the beverage service 115 can receive a quantity of a beverage dispensed from a valve 160 from the beverage slave service 172. The beverage service 115 can calculate a cost of the beverage 151 dispensed and deduct the cost from the credit 148, similar to when a beverage is dispensed from valve 127. In some embodiments, the credit 148 is an amount owed by the user for the beverages previously acquired.

The beverage service 115 can include be set into a maintenance mode so a service technician can service the computing environment 103. When in maintenance mode, the service technician can clean lines and fix any problems. The beverage service 115 can track the length of time since a maintenance mode has been initiated, and alert an administrator to the length of time. In one example, when the length of time since the last maintenance mode has been entered or exited exceeds a threshold, the beverage service 115 can generate and send an alert.

Figure 2:
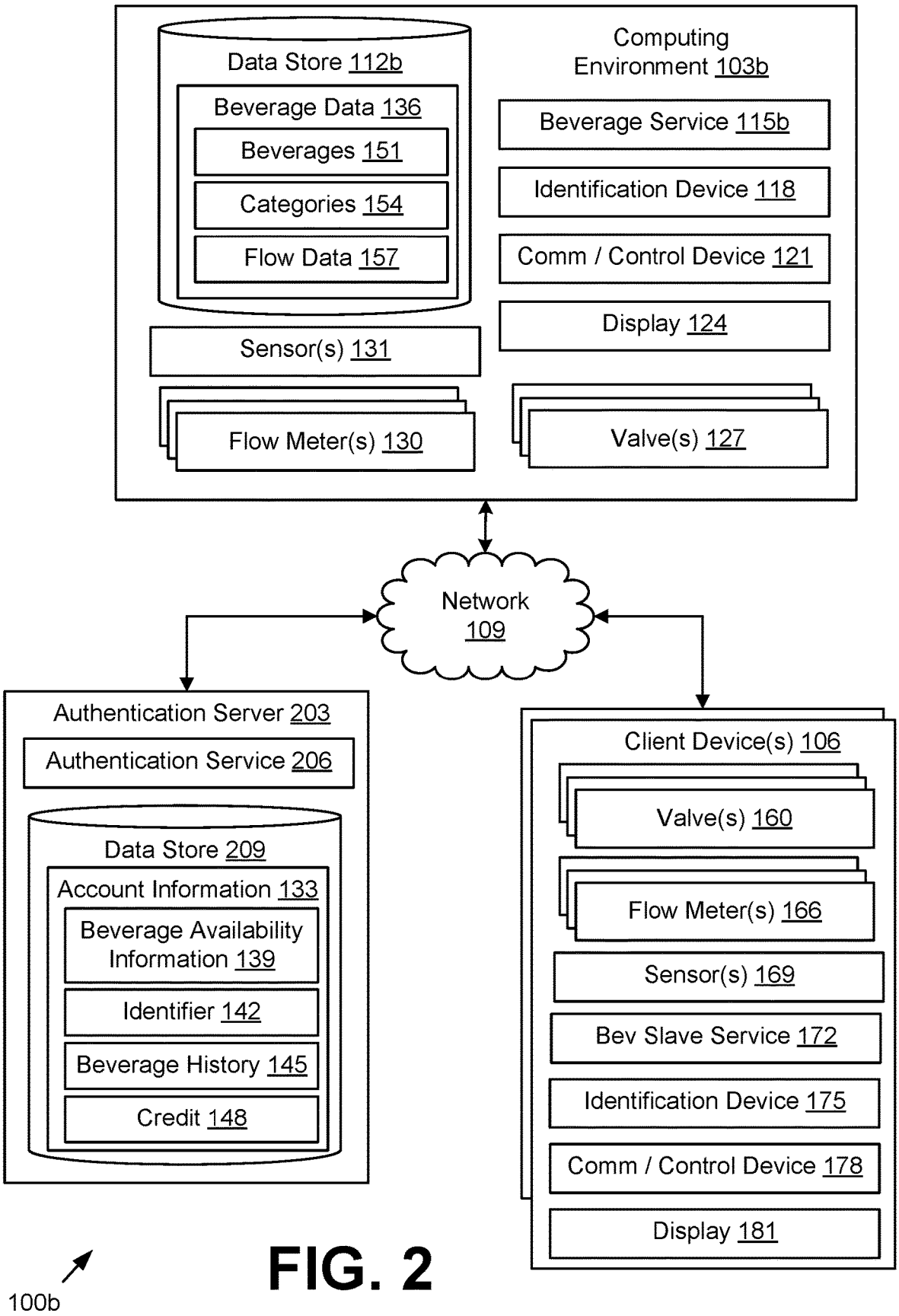
FIG. 2 is a drawing of a networked environment according to various example embodiments

Turning to FIG. 2, shown is a networked environment 200 according to various embodiments. The networked environment 200 includes a computing environment **103*b*, a client device 106, and an authentication server 203, which are in data communication with each other via a network 109. In networked environment 100*b*, authentication of the identifier is moved from the computing environment 103*b* to an authentication server 203**.

The computing environment **103*b* can include a data store 112*b*, both of which are similar to computing environment 103 and data store 112 of FIG. 1 except that the account information 133 is stored in the authentication server 203. The computing environment can also include a beverage service 115*b*, which can include all of the functionality of beverage service 115 except as noted. The authentication server 203 includes an authentication service 206 and a data store 209. The data store 209 can include the account information 133, including beverage availability information 139, identifier 142, beverage history 145, and credit 148**.

The beverage service **115*b* can send an authentication request to the authentication service 206 when an identifier is read from identification device 118. The authentication request can include the identifier can be verified against account information 133 to authenticate as identifier 142**.

The authentication service 206 can send the account information 133 corresponding to the identifier 142 to the beverage service 115*b*.

Similarly, the beverage slave service 172 can authenticate an identifier read from identification device 175 by sending an authentication request to the authentication service 206. In one embodiment, the beverage slave service 172 sends the authentication request to the beverage service 115*b*, and the beverage service 115*b* authenticates the request with the authentication service 206. The beverage service 115*b* can forward the request to the authentication service 206. The beverage service 115*b* can process the request before sending another authentication request on behalf of the beverage slave service 172. For example, the beverage service 115*b* can modify the request to attach one or more category 154 corresponding to the beverages 151 available on the client device 106 to the authentication request.

When a user dispenses a beverage 151 from the client device 106, the beverage slave service 172 can send a resulting quantity and type of beverage 151 dispensed to one or more of the beverage service 115*b* or the authentication service 206. In one example, the beverage service 115*b* records properties regarding the quantity dispensed in beverage data 136, such as, a history of consumption for the beverage 151. The beverage service 115*b* can forward on the beverage consumption data to the authentication service 206. Additionally, the beverage service 115*b* can store sensor data 169 included in the request from the beverage slave service 172. As an example, the beverage service 115/115*b* can store a history of temperatures and/or pressures at various locations in the client device 106 in beverage data 136. Similarly, readings from sensors 131 can be stored by beverage service 115/115*b* in beverage data 136 from computing environment 103/103*b*.

The authentication server 203 can be a third party authentication service. As an example, a cruise ship company can deploy a keycard system for all cruise customers. The keycards can be read by identification device 118/175 and authenticated with the authentication service 206 operated by the cruise ship company. Cruise customers can charge purchases of beverages 151 to credit 148, such as, for example, a cruise account.

Figure 3:
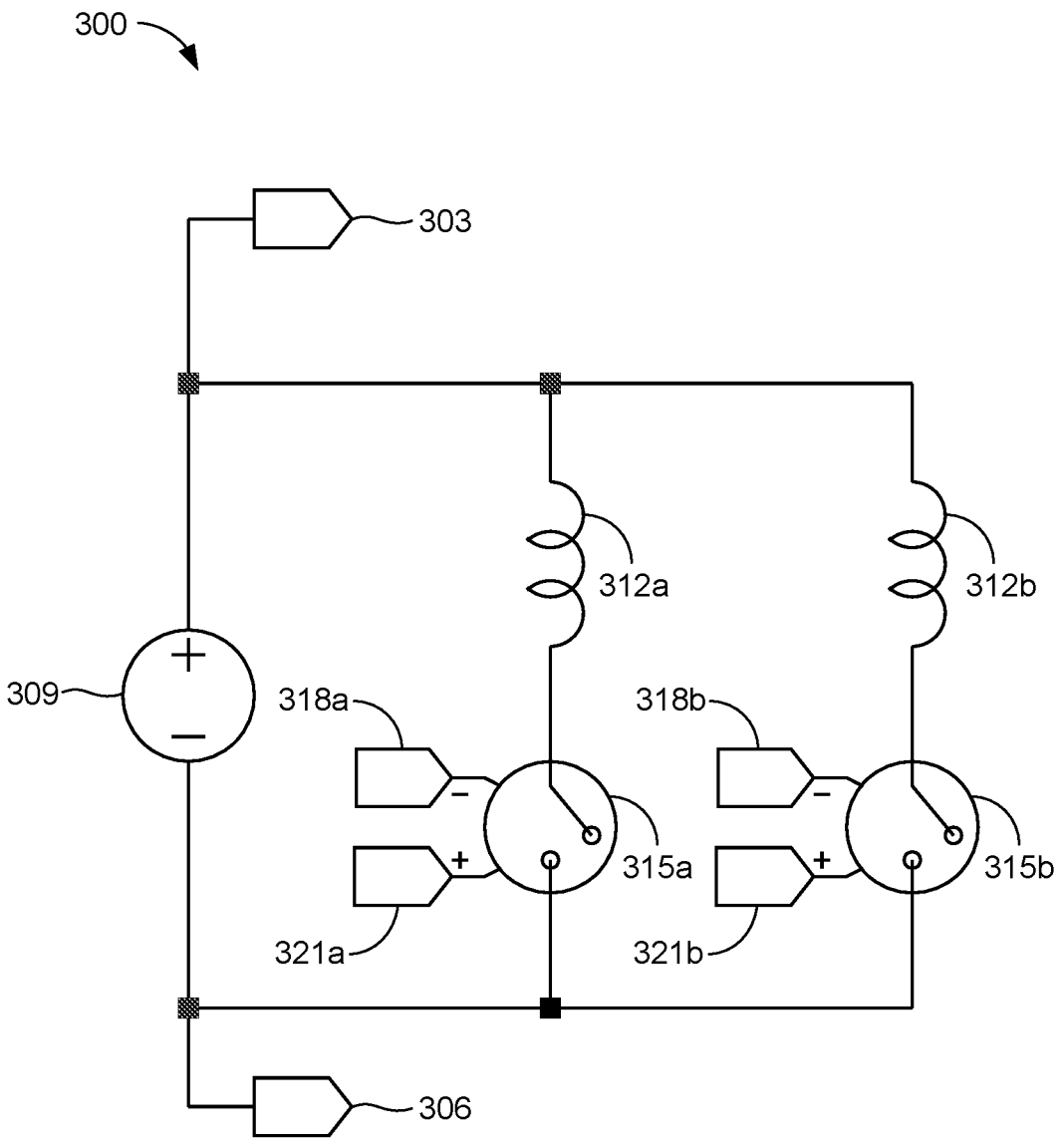
FIG. 3 illustrates a circuit diagram including valves in the networked environment of FIG. 1 according to various example embodiments.

Turning to FIG. 3, shown is a circuit 300 for controlling the dispensing of beverages according to various embodiments of the present disclosure. The circuit 300 can include a positive terminal 303 and a ground terminal 306 coupled to a positive output and a ground output of a power supply 309, respectively. The circuit 300 can also include one or more control valves 312*a* and 312*b* and one or more switches 315*a* and 315*b*. In one embodiment, a valve 127 can include a circuit 300 to enable and disable dispensing of a beverage 151. The power supply 309 can be a direct current (DC) power supply.

The control valves 312*a* and 312*b* can include a magnetic component configured to move from a first position when a potential difference is applied across the control valve 312*a* or 312*b* and a second position when little or no potential difference is applied across the control valve 312*a* or 312*b* or the control valve 312*a* or 312*b* is in an open circuit. The control valves 312*a* and 312*b* can be an electromagnet. In one embodiment, the control valves 312*a* and 312*b* enable dispensing of a beverage 151 when in the first position and disable dispensing of the beverage 151 when in the second position. In another embodiment, the control valves 312*a* and 312*b* enable dispensing of a beverage 151 when in the second position and disable dispensing of the beverage 151 when in the first position.

The positions for control valves 312*a* and 312*b* can be controlled by switches 315*a* and 315*b*, respectively. As an example, when switch 315*a* has a positive potential difference applied from contact 321*a* to contact 318*a*, the switch 315*a* is turned on. When switch 315*a* is turned on, control valve 312*a* is in the first position, while when switch 315*a* is turned off (e.g., a positive potential difference that exceeds a threshold is not applied from contact 321*a* to contact 318*a*), the control valve 312*b* is in the second position. The control valve 312*b* can similarly be controlled by contacts 321*b* and 318*b* of the switch 315*b*.

In some embodiments, the circuit 300 is controlled by a communication and control device 121. As an example, the circuit 300 can be coupled to a PLC device. In this example, a first common from the PLC can be coupled to the contact 303, the contact 321*a*, and contact 321*b*. A first output of the PLC can be coupled to contact 318*a* and a second output of the PLC can be coupled to contact 318*b*. The contact 306 can be coupled to a second common from the PLC. A positive potential difference can exist between the first common and the second common from the PLC.

The positive potential difference can equal the voltage of power supply 309. The PLC can cause the first output and/or the second output to be coupled to either the first common or the second common. As an example, when the PLC sets contact 318*a* to be coupled to the first common, no potential difference exists between contact 318*a* and 321*a*, and thus the switch 315*a* is in the second position. As a further example, when the PLC sets contact 318*a* to be coupled to the second common, a potential difference exists between contact 318*a* and 321*a*, and thus the switch 315*a* is in the first position.

Figure 4:
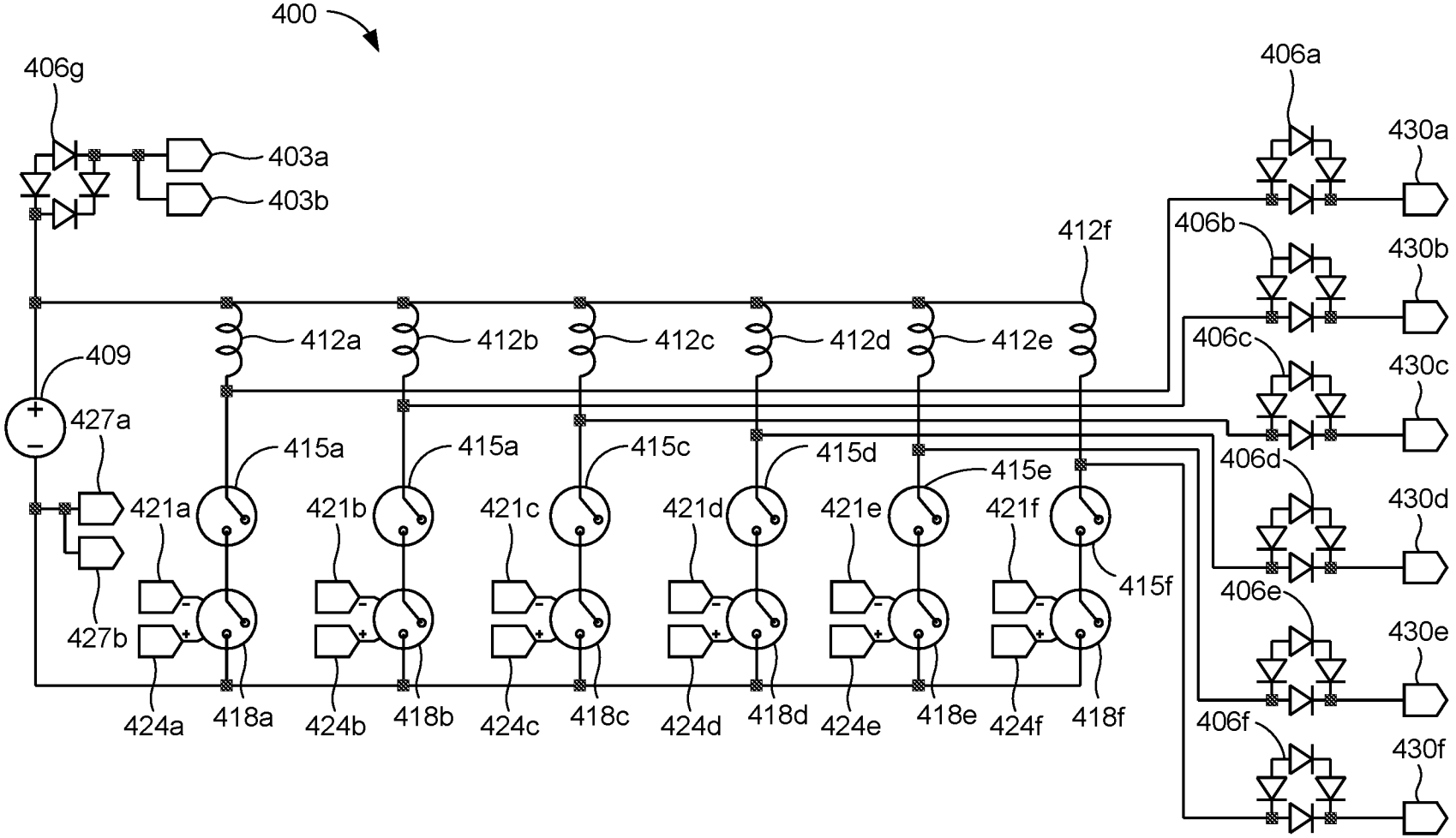
FIG. 4 illustrates a circuit diagram including valves in the networked environment of FIG. 1 according to various example embodiments.

With reference to FIG. 4, shown is a circuit 400 for controlling the dispensing of beverages according to various embodiments of the present disclosure. The circuit 400 functions similar to the circuit 300 except that, as shown, circuit 400 includes capability for six valves 127 rather than two valves 127, the circuit 400 can identify when the valve is open, and a ratio mixing device is utilized. Although the circuits 300 and 400 are shown with two and six valves, respectively, the circuits 300 and 400 can include any number of valves. The circuit 400 includes contacts 403*a-b*, voltage regulators 406*a-g*, a power supply 409, control valves 412*a-f*, tap valve switches 415*a-f*, switches 418*a-f* with contacts 421*a-f* and 424*a-f*, contacts 427*a-b*, and contacts 430*a-f*.

The power supply 409 can be an alternating current (AC) power supply. When an AC power supply is used, one or more voltage regulators 406*a-g* can be used to regulate voltage to be accepted by a digital circuit. As an example, the voltage regulators 406*a-g* can be coupled to general purpose input/output (GPIO) pins of a microprocessor or inputs of a PLC circuit without damaging the digital circuit. In one example, the voltage regulators 406*a-g* are analog to digital converters (ADC), while in other examples, the voltage regulators 406*a-g* are diodes configured as shown in FIG. 4.

In some embodiments, a DC power supply is used for power supply 409, similar to circuit 300. In this embodiment, the voltage regulators 406*a-g* are omitted, contacts 403*a-b* are merged into a single contact 403, and contacts 427*a-b* are merged into a single contact 427. Further, the single contact 403 is connected similarly to contact 303, and the single contact 427 is connected similarly to contact 306. When the DC power supply is used, the circuit 400 can dispense a beverage 151 without mixing multiple ingredients.

The control valves 412*a-f* can include one or more mixing electromagnetic device that toggles between dispensing two or more fluids. Characteristics of a periodic signal from the power sources 409 can be adjusted to change a ratio between the two or more fluids. As an example, the periodic signal can alternate between a high voltage and a low voltage, but the voltage can be high for twice as long as the voltage is low for each period of the signal. The high voltage can correspond to dispensing soda water, while the low voltage can correspond to dispensing syrup. In this example, soda water would be dispenses at a two to one ration with syrup.

The periodic signal can be programmed to adjust the ratio based on a formula for a given beverage 151. In one embodiment, the beverage service 115 configures the communication and control device 121 to generate a signal based on a ratio in beverage data 136 for a given beverage 151. In one example, the communication and control device 121 can generate a pulse width modulated signal and pass the signal through a filter to generate the AC power signal with the desired ratio.

Similar to the circuit 300, when a positive voltage is applied across any of contacts 424*a-f* to 421*a-f*, the corresponding switch 418*a-f* enables dispensing of a beverage. When beverage dispensing is enabled, a user can use a manual switch or valve, such as tap valve switches 415*a-f*, to dispense a beverage 151. In circuit 400, when one of the tap valve switches 415*a-f* are triggered while the corresponding switch 418*a-f* is on, a beverage is dispensed from the corresponding valve 412*a-f*. Further, while the beverage is being dispensed, a corresponding contact 430*a-f* is pulled low. Each of contacts 430*a-f* can be connected to an input of the communication and control device 121 to be read.

As an example, when a user is authorized for dispensing a beverage 151 on valve 412*a*, a potential difference is applied across 424*a* and 421*a* to enable switch 418*a*. The user can press a container against the tap valve switch 415*a* to dispense the beverage 151. An input of the communication and control device 121 can read contact 430*a* to determine that the user is dispensing the beverage.

Further, the communication and control device 121 can determine a length of time that the user dispenses the beverage based on a length of time that contact 430*a* is pulled low. In one embodiment, a flow meter 130 is not used and the amount of dispensed beverage is determined by multiplying the length of time that the beverage 151 is dispensed by a predetermined flow rate for that beverage 151.

In one embodiment similar to circuit 300, the tap valve switch 415*a*, voltage regulators 406*a-f* and contacts 430*a-f* are omitted. In this embodiment, the valves 412*a-f* function similar to valves 312*a-b* in circuit 300 with the exception that the valves 412*a-f* mix a ratio of two or more fluids (e.g. syrup and soda water) using the AC power supply 409.

Figure 5:
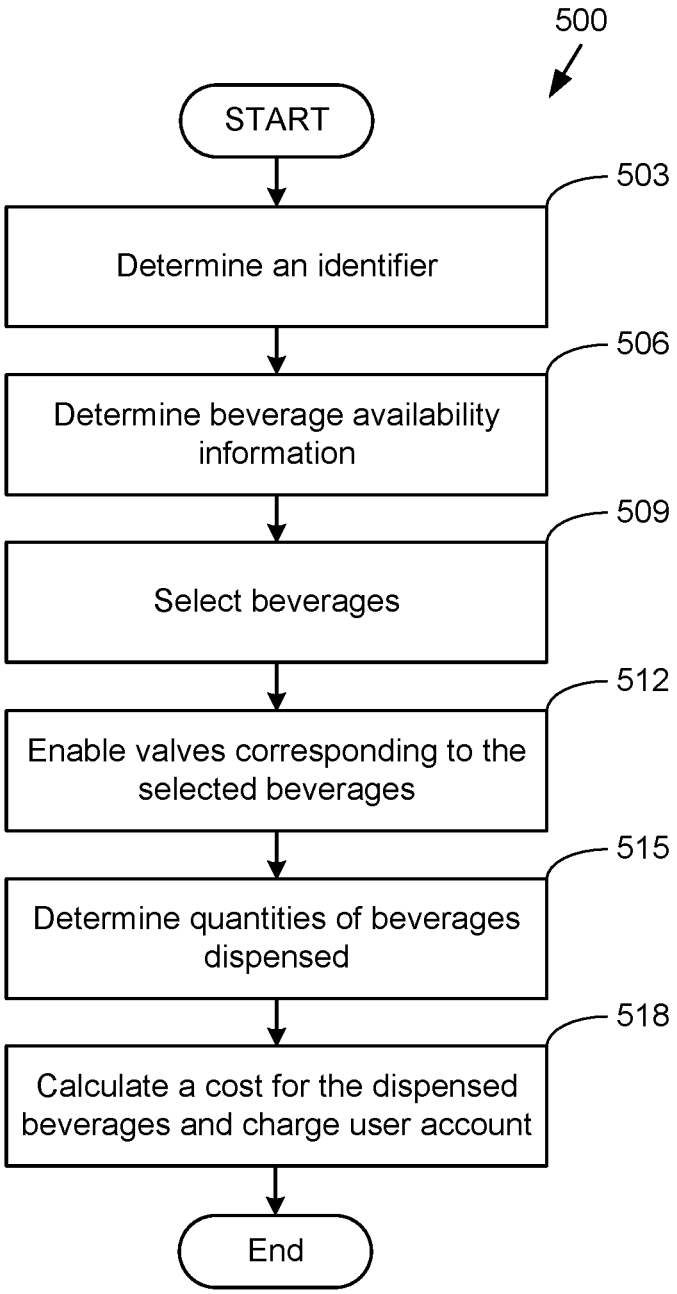
FIG. 5 illustrates an example flowchart of certain functionality implemented by portions of a beverage service executed in a computing environment in the networked environment of FIG. 1 according to various embodiments of the present disclosure.
Figure 6:
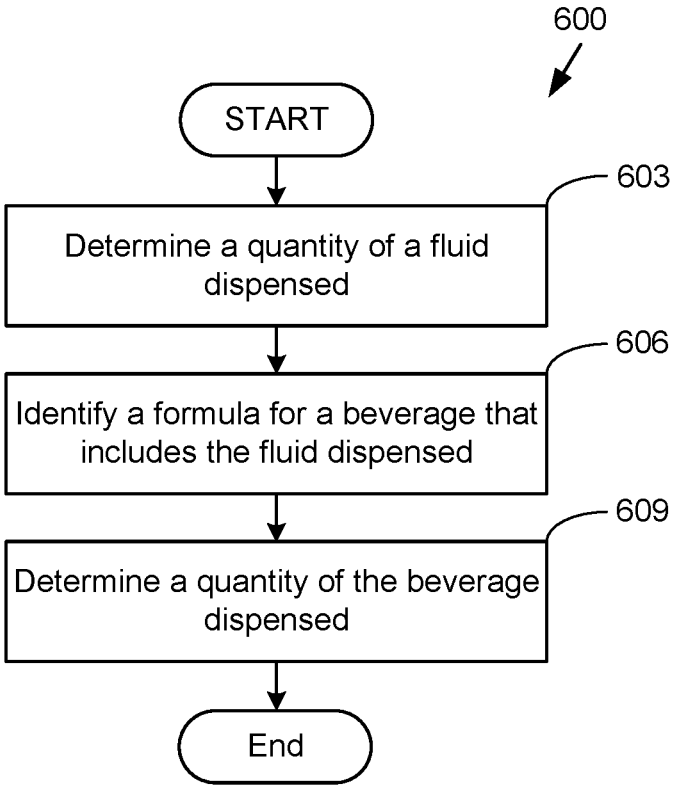
FIG. 6 illustrates an example flowchart of certain functionality implemented by portions of a beverage service executed in a computing environment in the networked environment of FIG. 1 according to various embodiments of the present disclosure.

Before turning to the process flow diagrams of FIGS. 5 and 6, it is noted that embodiments described herein may be practiced using an alternative order of the steps illustrated in FIGS. 5 and 6. That is, the process flows illustrated in FIGS. 5 and 6 are provided as examples only, and the embodiments may be practiced using process flows that differ from those illustrated. Additionally, it is noted that not all steps are required in every embodiment. In other words, one or more of the steps may be omitted or replaced, without departing from the spirit and scope of the embodiments. Further, steps may be performed in different orders, in parallel with one another, or omitted entirely, and/or certain additional steps may be performed without departing from the scope and spirit of the embodiments.

Referring next to FIG. 5, shown is a flowchart that provides one example of the operation of a portion of a beverage dispensing process 500 according to various embodiments. It is understood that the flowchart of FIG. 5 provides merely an example of the many different types of functional arrangements that may be employed to implement the operation of the portion of the beverage service 115 as described herein. As an alternative, the flowchart of FIG. 5 may be viewed as depicting an example of elements of a method implemented in the computing environment 103 (FIG. 1) according to one or more embodiments.

Beginning with box 503, the beverage dispensing process 500 includes determining an identifier. For example, the identification device 118 or 175 can read an identifier from a user device, such as an RFID card or another medium. The beverage service 115 or the beverage slave service 172 can read the identifier from the identification device 118 or 175, respectively. In one example, the beverage service 115 can receive the identifier from the identification device 118 through a USB cable. In one example, the beverage slave service 172 reads the identifier from the identification device 175, and the beverage service 115 receives the identifier from the beverage slave service 172.

The beverage service 115 can validate the identifier against the data store 112. As an example, the beverage service 115 can look up the identifier in identifier 142. In one example, the beverage availability information 139 indicates that a first category 154 is available for consumption for a user account associated with the identifier 142, while a second category 154 is unavailable for consumption for the user account.

In box 506, the beverage dispensing process 500 includes determining beverage availability information that corresponds to the identifier. As an example, the beverage service 115 can query the data store 112 for the beverage availability information 139 associated with the identifier 142. The beverage availability information 139 can include details as to what categories 154 of beverages 151 that the user of the identifier 142 is authorized to dispense in addition to what quantities of each beverage 151 and/or each category 154 that the user can dispense.

In box 509, the beverage dispensing process 500 includes selecting beverages. As an example, the beverage service 115 can select beverages 151 and/or categories 154 to enable based on the beverage availability information 139. In one example, a hard alcohol category 154 corresponding to hard liquor is disabled because a user associated with the identifier 142 is under 21 years old. In this example, beverages 151 corresponding to the hard alcohol category 154 are not selected.

In another example, a soda category 154 is not selected because a user associated with the identifier 142 is not enrolled in a soda beverage package. In this example, the soda category 154 can be selected for identifiers 142 that include the soda beverage package. In yet another example, a profile associated with the identifier 142 indicates a spending limit for a beer category 154, and beverages 151 corresponding to the beer category 154 are selected unless or until the spending limit is reached.

In box 512, the beverage dispensing process 500 includes enabling valves corresponding to selected beverages. The beverage service 115 can send a command to enable valves 127 that correspond to the selected beverages 151. In one embodiment, the beverage service 115 can send a message to the beverage slave service 172, and the beverage slave service 172 can send a command to enable valves 160 that correspond to selected beverages 151. The command can be sent to the communication and control device 121 and/or 178, and the communication and control device 121/178 can enable the selected valves 127/160.

In box 515, the beverage dispensing process 500 includes determining quantities of beverages dispensed. The beverage service 115 can determine a quantity of a beverage 151 that has been dispensed from a valve 127. The communication and control device 121/178 can count a number of pulses or ticks from a flow meter 130. The beverage service 115 or beverage slave service 172 can read the count from the communication and control device 121 or 178, respectively. In some embodiments, the beverage service 115 determines the quantity of a beverage 151 dispensed by determining an amount of time that a switch corresponding to a valve 127 is in an on position and multiplying the time by a rate of flow for the valve 127. For example, the communication and control device 121/178 can determine that a tap valve switch 415 has been triggered based on an input 430 and send a command to beverage service 115 or beverage slave service 172.

In one example, the quantity is predetermined based on the beverage data 136, and triggering a switch corresponding to a valve 127 causes the predetermined quantity to be dispensed from the valve 127. The predetermined quantity can correspond to categories 154. As an example, a soda category 154 can dispense twenty ounces of soda from a selected one of a number of soda valves 127 upon triggering a corresponding switch for the selected valve 127, such as, for example, a tap control switch 415.

In box 518, the beverage dispensing process 500 includes calculating a cost for the dispensed beverages and charging a user account for the quantities dispensed. The beverage service 115 can calculate a cost of a beverage 151. In some examples, the cost of the beverage 151 is a cost per ounce of the beverage 151 multiplied by a number of ounces dispensed. In another example, a user can purchase a package that includes unlimited quantities of beverages from a category 154.

Some packages can include a set number of beverages or ounces of beverages, which can be a one-time set number or a recurring set number, such as per day. The beverage service 115 can prevent additional beverages from the category 154 from being dispensed or charge the user account for any additional beverages 151 from the category 154. In one example, the beverage service 115 renders a warning that the user account has exhausted a package and any additional beverages 151 from the category 154 will be charged.

The beverage service 115 can require a manual confirmation before allowing further beverages 151 from the category 154 to be dispensed. In one example, an administrator must indicate that the user account can acquire additional beverages 151 from the category 154. In another example, the beverage service 115 can render a warning on the display 124. The beverage service 115 can receive an acceptance command through a touch screen of the display 124, through a manual button push, by receiving and validating a biometric signature from the user, by blowing in a breathalyzer sensor 131 and having an alcohol intoxication level at or below a threshold. For example, an alcohol category 154 can be restricted to a predefined number of drinks, and the beverage service 115 can increase the number of drinks upon the user successfully blowing a breathalyzer sensor 131 with an alcohol intoxication level at or below the threshold.

In some embodiments, a first identifier 142 can be scanned for purchasing the beverage 151, while a second identifier 142 is scanned as consuming the beverage 151. A first user associated with the first identifier 142 can purchase a second user associated with the second identifier 142 a beverage 151 without associating the beverage 151 as consumed by the first user in beverage history 145. In addition, the beverage history 145 for the second identifier 142 can include consumption of the beverage 151.

In one example, an alcoholic category 154 can be limited to ten beverages 151 for each identifier 142. A identifier 142 with ten beverages 151 already purchased from the alcoholic category 154 can purchase a beverage 151 for another user corresponding to an identifier with eight beverages 151 purchases from the alcoholic category 154. In this example, the beverage service 115 can increment the number of purchases for the other user to nine after dispensing the beverage 151 from the alcoholic category 154.

In one embodiment, a first user with a first identifier 142 can wager a beverage 151 with a second user with a second identifier 142. If the first user loses, the wagered beverage credit can be stored in credit 148 for the second identifier 142 and deducted from the first identifier 142. In one example, the wagered beverage credit is held and only deducted from the credit 148 corresponding to the first identifier 142 after a beverage 151 is dispensed by the second identifier 142. In this example, if the second identifier 142 fails to redeem the beverage credit, the credit 148 for the first identifier 142 is never charged for the wagered beverage 151.

In another embodiment, a dealer or administrator can give a user credit for a free drink based on gambling history in a casino. In one example, a third party service sends a message indicating an amount of money wagered on a gaming device, such as a slot machine, a sports bet system, or bets made on a table game. In another example, an administrator can gift the player a free drink using an administrator identification item. The beverage service 115 can read the administrative identification item via the identification device 118 and render an administrative user interface on display 124. The beverage service 115 can receive a request to credit a user account. The beverage service 115 can read an identifier 142 from an identification item of the user via the identification device 118. In one example, the beverage service 115 can render a message instructing the administrator to scan the user identification device 118.

Referring next to FIG. 6, shown is a flowchart that provides one example of the operation of a portion of a beverage dispensing process 600 according to various embodiments. It is understood that the flowchart of FIG. 6 provides merely an example of the many different types of functional arrangements that may be employed to implement the operation of the portion of the beverage service 115 and/or an application or hardware within the communication and control device 121 as described herein. As an alternative, the flowchart of FIG. 6 may be viewed as depicting an example of elements of a method implemented in the computing environment 103 or a client device 106 (FIG. 1) according to one or more embodiments.

Beginning at box 603, the dispensing process 600 includes determining a quantity of a fluid dispensed. The communication and control device 121/178 can receive one or more pulses from an electric input, such as, for example, a flow meter 130/166. The flow meter 130/166 can be configured to generate a pulse when a predefined quantity of a fluid passes through the flow meter 130/166. The beverage service 115 can determine a count of the pulses. The beverage service 115 can determine which of the beverages 151 available on valves 127 is being dispensed. For example, the communication and control device 121/178 can identify one of the tap control switches 415*a-f* as being triggered based on contacts 430*a-f*.

If two or more of tap control switches 415*a-f* are triggered simultaneously, a ratio of the duration that the switches 415*a-f* are triggered can be used to determine a ratio of pulses to assign to each switch 415. For example, if switch 415*a* is triggered for three seconds, switch 415*b* is triggered for two seconds, and twenty pulses were received from a flow meter 130, the beverage service 115 can assign twelve pulses to switch 415*a* and eight pulses to switch 415*b* because each of the five seconds of total triggered time correspond to four pulses per second. Each of the switches 415*a-f* can correspond to a different beverage 151.

At box 606, the dispensing process 600 includes identifying a formula for a beverage that includes the fluid dispensed. The beverage service 115 can look up a formula in beverage data 136 for the beverages 151 for each valve 127 in the computing environment 203. In some embodiments, the beverage service 115 looks up the formula for beverages 151 when the beverage 151 is finished dispensing from a valve 127. In some embodiments, the formula is a ratio of a single ingredient to other ingredients in the beverage 151. In other embodiments, the formula can include a listing of the ingredients in a beverage 151 including a quantity of each ingredient.

At box 609, the dispensing process 600 includes determining a quantity of the beverage dispensed. The beverage service 115 can calculate a dispensed quantity of a beverage 151. The beverage 151 can correspond to a triggered switch 415. The quantity of the beverage dispensed can be determined based on a count of pulses from the electric input. The beverage dispensed can also be determined based on the formula. As an example, a cola beverage 151 with a two parts soda water and one part syrup ratio can have a formula of "1.5" because a flow meter 130 in the example is configured to measuring soda water. In this example, when ten ounces of soda water are dispensed, the beverage service 115 can calculate that fifteen ounces of cola were dispensed because five ounces of syrup was also dispensed.

Figure 7:
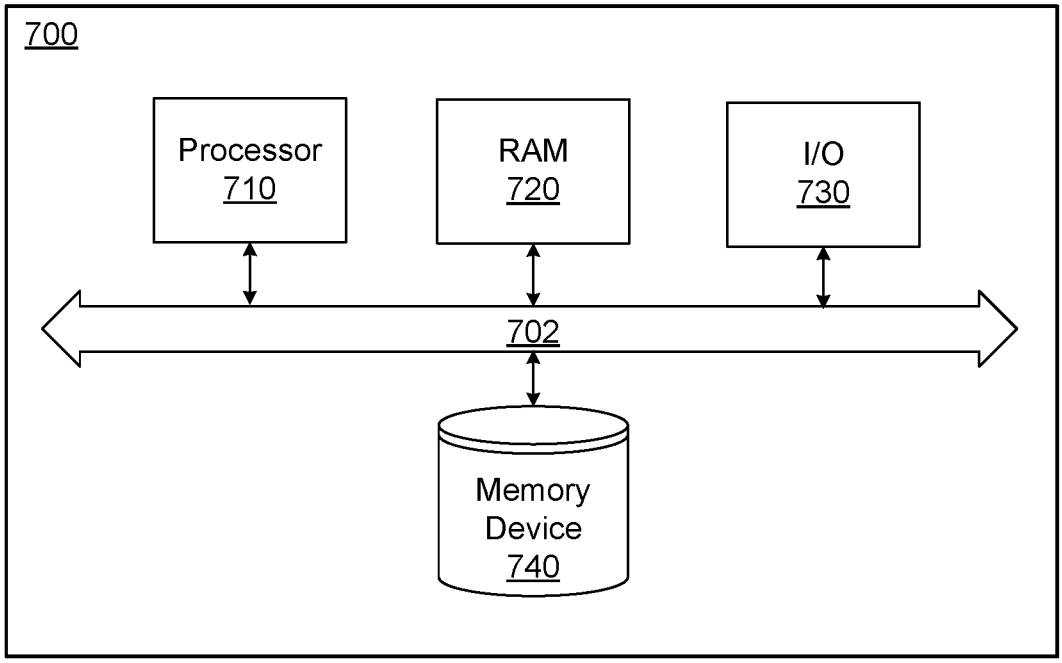
FIG. 7 is a schematic block diagram that illustrates an example computing environment employed in the networked environment of FIG. 1 according to various embodiments.

With reference to FIG. 7, shown is a schematic block diagram of the computing device 700 according to an embodiment of the present disclosure. The computing environment 103, computing environment 103*b*, client device 106, and authentication server 203 each include one or more computing devices 700. Each computing device 700 includes at least one processor circuit, for example, having a processor 710, a memory 720 and 740, input and output 730, all of which are coupled to a local interface 702. To this end, each computing device 700 may comprise, for example, at least one server computer or like device. The local interface 702 may comprise, for example, a data bus with an accompanying address/control bus or other bus structure as can be appreciated.

Stored in the memory 720 or 740 are both data and several components that are executable by the processor 710. In particular, stored in the memory 720 or 740 and executable by the processor 710 are the beverage service 115, the beverage service 115*b*, the beverage slave service 172, the authentication service 206, an application in the communication and control device 121 or 178, and potentially other applications. Also stored in the memory 740 may be a data store 112, 112*b*, 209, and other data. In addition, an operating system may be stored in the memory 720 or 740 and executable by the processor 710.

It is understood that there may be other applications that are stored in the memory 720 or 740 and are executable by the processor 710 as can be appreciated. Where any component discussed herein is implemented in the form of software, any one of a number of programming languages may be employed such as, for example, C, C++, C #, Objective C, Java®, JavaScript®, Perl, PHP, Visual Basic®, Python®, Ruby, Flash®, or other programming languages.

A number of software components are stored in the memory 720 or 740 and are executable by the processor 710. In this respect, the term "executable" means a program file that is in a form that can ultimately be run by the processor 710. Examples of executable programs may be, for example, a compiled program that can be translated into machine code in a format that can be loaded into a random access portion of the memory 720 or 740 and run by the processor 710, source code that may be expressed in proper format such as object code that is capable of being loaded into a random access portion of the memory 720 or 740 and executed by the processor 710, or source code that may be interpreted by another executable program to generate instructions in a random access portion of the memory 720 or 740 to be executed by the processor 710, etc. An executable program may be stored in any portion or component of the memory 720 or 740 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 720 and 740 are defined herein as including both volatile and nonvolatile memory and data storage components. Volatile components are those that do not retain data values upon loss of power. Nonvolatile components are those that retain data upon a loss of power. Thus, the memory 720 and 740 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 710 may represent multiple processors 710 and/or multiple processor cores and the memory 720 or 740 may represent multiple memories 720 that operate in parallel processing circuits, respectively. In such a case, the local interface 702 may be an appropriate network that facilitates communication between any two of the multiple processors 710, between any processor 710 and any of the memories 720, or between any two of the memories 720, etc. The local interface 702 may comprise additional systems designed to coordinate this communication, including, for example, performing load balancing. The processor 710 may be of electrical or of some other available construction.

Although the beverage service 115, the beverage service 115*b*, the beverage slave service 172, the authentication service 206, an application in the communication and control device 121 or 178, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowcharts of FIGS. 5 and 6 show the functionality and operation of an implementation of portions of the beverage service 115. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 710 in a computer system or other system. The machine code may be converted from the source code, etc. If embodied in hardware, each block may represent a circuit or a number of interconnected circuits to implement the specified logical function(s).

Although the flowcharts of FIGS. 5 and 6 show a specific order of execution, it is understood that the order of execution may differ from that which is depicted. For example, the order of execution of two or more blocks may be scrambled relative to the order shown. Also, two or more blocks shown in succession in FIGS. 5 and 6 may be executed concurrently or with partial concurrence. Further, in some embodiments, one or more of the blocks shown in FIGS. 5 and 6 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the beverage service 115, the beverage service 115*b*, the beverage slave service 172, the authentication service 206, an application in the communication and control device 121 or 178, that comprises software or code can be embodied in any non-transitory computer-readable medium for use by or in connection with an instruction execution system such as, for example, a processor 710 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Further, any logic or application described herein, including the beverage service 115, the beverage service 115*b*, the beverage slave service 172, the authentication service 206, an application in the communication and control device 121 or 178, may be implemented and structured in a variety of ways. For example, one or more applications described may be implemented as modules or components of a single application. Further, one or more applications described herein may be executed in shared or separate computing devices or a combination thereof. For example, a plurality of the applications described herein may execute in the same computing device 700, or in multiple computing devices in the same computing environment 103. Additionally, it is understood that terms such as "application," "service," "system," "engine," "module," and so on may be interchangeable and are not intended to be limiting.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A system comprising:

at least one computing device; and machine-readable instructions that, when executed, cause the at least one computing device to at least:

receive an identifier from an identification device;

identify beverage availability information corresponding to the identifier;

authorize a subset of a plurality of valves based at least in part on the beverage availability information;

receive an input corresponding to an action associated with a beverage dispensed from at least one valve of the plurality of valves;

enable the at least one valve, a beverage being dispensed from the at least one valve in response to the input corresponding to the action associated with the beverage dispensed from the at least one valve being received while the at least one valve is enabled; and determine a quantity of the beverage dispensed from the at least one valve.

2. The system of claim 1, wherein the machine-readable instructions, when executed, further cause the at least one computing device to at least identify a subset of a plurality of beverage categories based at least in part on the beverage availability information.

3. The system of claim 2, wherein the machine-readable instructions, when executed, further cause the at least one computing device to at least cause to be rendered an indication of the subset of the plurality of beverage categories on a display communicably coupled to the at least one computing device.

4. The system of claim 2, wherein the subset of the plurality of beverage categories corresponds to the subset of the plurality of valves.

5. The system of claim 1, wherein the machine-readable instructions, when executed, further cause the at least one computing device to at least send a command to disable the at least one valve in response to the quantity of the beverage dispensed from the at least one valve meeting a threshold.

6. The system of claim 1, wherein the machine-readable instructions that, when executed, cause the at least one computing device to determine the quantity of the beverage dispensed from the at least one valve further cause the at least one computing device to at least identify a number of pulses from at least one flow meter corresponding to the at least one valve.

7. The system of claim 1, wherein the machine-readable instructions that, when executed, cause the at least one computing device to determine the quantity of the beverage dispensed from the at least one valve further cause the at least one computing device to at least identify a predetermined quantity of the beverage associated with a beverage category corresponding to the at least one valve.

8. A system comprising:

at least one computing device; and machine-readable instructions that, when executed, cause the at least one computing device to at least:

identify beverage availability information based at least in part on an identifier;

receive an input corresponding to an action associated with a beverage dispensed from at least one valve of at least one beverage dispenser;

send a command to enable the at least one valve based at least in part on the beverage availability information;

determine that the beverage is being dispensed from the at least one valve in response to the at least one valve being enabled while the input corresponding to the action associated with the beverage dispensed from the at least one valve is being received; and determine a quantity of the beverage dispensed from the at least one valve.

9. The system of claim 8, wherein the at least one computing device is communicably coupled to a second computing device and the second computing device is communicably coupled to the at least one beverage dispenser.

10. The system of claim 9, wherein the machine-readable instructions, when executed, further cause the at least one computing device to at least:

identify the beverage availability information in response to receiving an authentication request including the identifier from the second computing device;

send the command to enable the at least one valve to the second computing device; and determine the quantity of the beverage dispensed from the at least one valve based at least in part on beverage consumption data received from the second computing device.

11. The system of claim 8, wherein the machine-readable instructions that, when executed, cause the at least one computing device to determine the quantity of the beverage dispensed from the at least one valve further cause the at least one computing device to at least determine an amount of time that the beverage is dispensed from the at least one valve.

12. The system of claim 8, wherein the machine-readable instructions, when executed, further cause the at least one computing device to at least:

send an authentication request including the identifier to a second computing device; and receive the beverage availability information from the second computing device.

13. The system of claim 8, wherein the beverage availability information comprises at least one beverage limit associated with the identifier.

14. The system of claim 8, wherein machine-readable instructions, when executed, further cause the at least one computing device to at least perform at least one remedial action based at least in part on a flow rate for the at least one valve.

15. A method comprising:

identifying, by at least one computing device, beverage availability information based at least in part on an identifier;

receiving, by the at least one computing device, an input corresponding to an action associated with a beverage dispensed from at least one valve of at least one beverage dispenser;

selecting, by the at least one computing device, the at least one valve based at least in part on the beverage availability information;

enabling, by the at least one computing device, the at least one valve;

in response to the input corresponding to the action associated with the beverage dispensed from the at least one valve of the at least one beverage dispenser being received while the at least one valve is enabled, dispensing the beverage from the at least one valve; and determining, by the at least one computing device, a quantity of the beverage dispensed from the at least one valve.

16. The method of claim 15, wherein the at least one valve is selected in response to receiving the input corresponding to the at least one valve.

17. The method of claim 15, further comprising calculating, by the at least one computing device, a threshold for dispensing based at least in part on the beverage availability information.

18. The method of claim 17, further comprising disabling, by the at least one computing device, the at least one valve based at least in part on the quantity of the beverage dispensed meeting the threshold for dispensing.

19. The method of claim 17, further comprising disabling, by the at least one computing device, access to at least one beverage category based at least in part on the quantity of the beverage dispensed meeting the threshold for dispensing.

20. The method of claim 17, wherein calculating the threshold for dispensing based at least in part on the beverage availability information comprises identifying at least one limit associated with the identifier.

* * * * *